United States Patent [19]

Curtis

[11] 4,377,935

[45] Mar. 29, 1983

[54] PRODUCE COOLER

[76] Inventor: Richard E. Curtis, 6590 Hansen Dr., Pleasanton, Calif. 94566

[21] Appl. No.: 302,317

[22] Filed: Sep. 14, 1981

[51] Int. Cl.[3] ..... F60H 3/04

[52] U.S. Cl. ..... 62/239; 62/414; 98/10

[58] Field of Search ..... 62/304, 239, 414; 98/10

[56] References Cited

U.S. PATENT DOCUMENTS

| | | | |
|---|---|---|---|
| Re. 17,998 | 3/1931 | Fleisher | 62/91 |
| 2,281,458 | 4/1942 | Schadegg | 62/231 |
| 3,246,592 | 4/1966 | Rath | 62/239 |
| 3,453,839 | 7/1969 | Sabin | 62/239 |
| 3,699,870 | 10/1972 | Cantagallo et al. | 62/239 |
| 4,123,917 | 11/1978 | Curtis et al. | 62/309 |
| 4,179,900 | 12/1979 | Corrigan | 62/231 |

*Primary Examiner*—Ronald C. Capossela
*Attorney, Agent, or Firm*—Gerald L. Moore

[57] ABSTRACT

A produce cooler for cooling produce placed on the floor in an enclosure and wherein the enclosure includes a cooling compartment for cooling air passing therethrough. The floor is formed of sections spaced apart to form slots therebetween through which cooling air can pass. Air passages are positioned beneath the floor in communication with the cooling compartment to carry air from the slots. A fan forces air through the cooling compartment such that produce placed along the slots will have air drawn thereacross for cooling.

5 Claims, 3 Drawing Figures

PRODUCE COOLER

FIELD OF THE INVENTION

In U.S. Pat. No. 4,123,917, Produce Cooler, with Richard E. Curtis et al as Inventors, and issued on Nov. 7, 1978, there is provided an enclosure into which produce such as lettuce, celery and the like, can be placed for cooling prior to shipment. The enclosure includes a wall extending between a cooling compartment and the produce to form a plenum through which air is pulled by a fan and passed through a cooler. The air is then circulated back into the produce enclosure. By positioning the produce containers adjacent the wall, the cooled air is pulled through the containers to pass in and around the produce for cooling purposes. In previous embodiments the wall has included a series of vertical slots through which the air passes.

Use of this type of cooling enclosure has shown that the produce adjacent the wall is cooled much more than the produce positioned further from the wall. With the produce stacked in rows extending away from the wall on each side of the slots, most of the air passes through the produce containers closest to the wall resulting in the uneven cooling. Also when the enclosure is not completely filled with produce, it has been necessary to cover those slots not adjacent produce containers and such covering has been somewhat difficult because the walls extend vertically.

It is the purpose of the present invention to improve upon this prior art type cooler by providing a produce cooler which makes more efficient use of the cooling enclosure and also more evenly cools the produce within the enclosure.

SUMMARY OF THE INVENTION

A produce cooler for cooling produce in containers and including an enclosure having side walls, ceiling and floor and wherein the floor comprises a plurality of elongated sections on which produce is placed in the containers with the floor sections being in spaced parallel relationship so as to form air passage slots therebetween. An air duct connects with each of these slots to transmit the air from the slots through a cooling compartment for cooling. The cooled air is then expelled back into the enclosure. By stacking the containers to each side of the floor slots and covering the space between adjacent containers and aligning with the floor slots, air pulled into the slots is caused to flow through the containers for cooling the produce therein.

DESCRIPTION OF THE INVENTION

Figure 1:
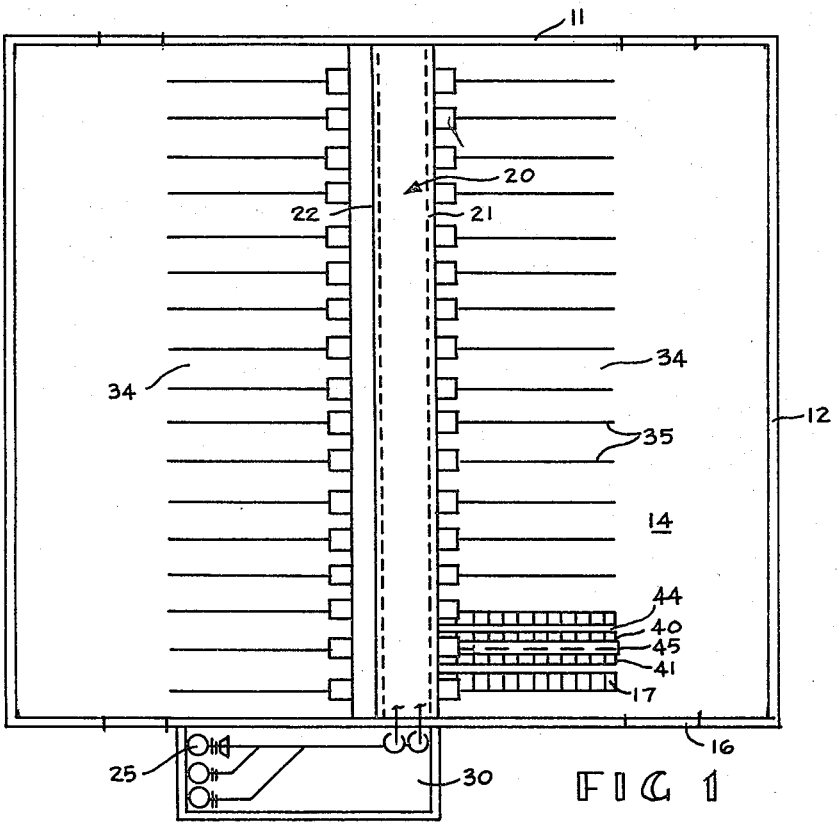
FIG. 1 is a top plan view of a produce cooler incorporating the subject invention.
Figure 2:
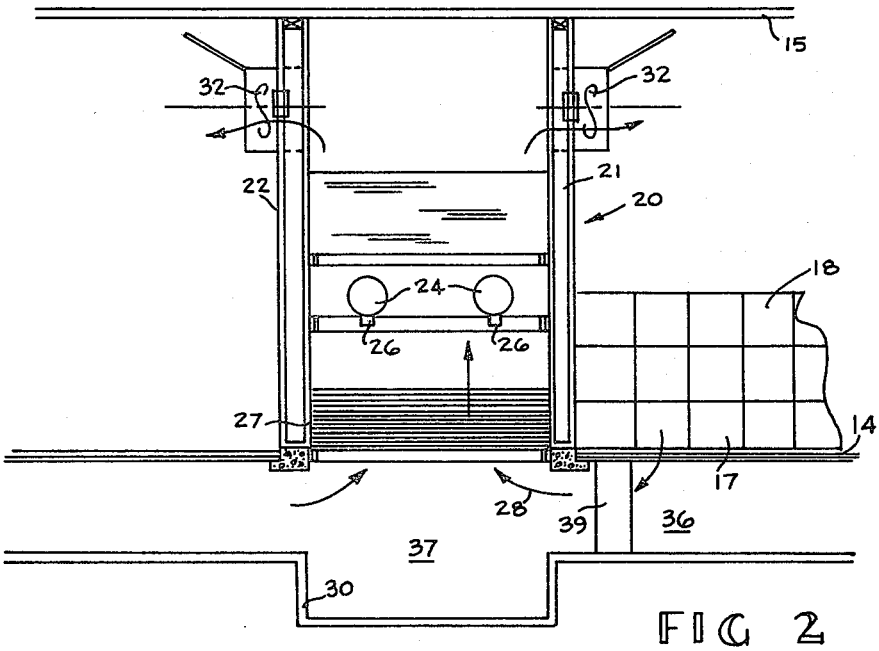
FIG. 2 is an enlarged cross-sectional view along the line 2—2 of FIG. 1.

The floor plan of a produce cooling enclosure 10 is shown in FIG. 1 comprising side walls 11 and 12, a floor 14 and a ceiling 15 (FIG. 2). The produce is brought into the building through doors 16. Generally the produce is carried on pallets 17 which are picked up by a forklift truck (not shown). The produce such as lettuce, celery, asparagus and the like, is packed into cartons 18 in the field and is usually brought directly for cooling to remove the field heat before being loaded into vehicles for shipment to the market. Additionally the passage of air through the produce has a cleansing effect to remove dust, contaminants, insecticides and the like. Preferably the air is maintained quite moist so as not to dry out the produce.

For supplying cool air to the product, there is provided a cooling tower 20 having side walls 21 and 22 extending up from the floor 14. These side walls are waterproof and enclose a pair of horizontally positioned manifolds 24 which carry chilled water from a refrigerator unit 25 (FIG. 1). Spaced along each of the manifolds are a plurality of spray heads 26 which distribute the water in a fine mist downward onto a heat exchanger 27. Preferably this heat exchanger comprises a plurality of layers of perforated expanded aluminum sheets through which the water can drop in counter flow to air rushing upward as indicated by the arrows 28. Thus there is a close contact between the air and water and an efficient heat exchange is effected. The water is chilled to approximately 32° F. (0° C.) to cool the air to a temperature of approximately 32° F. to 50° F. depending upon the quantity of air being passed through the cooler. The water is caught in the flume 30 and pumped back to the refrigerating unit for recooling and recycling.

The water in flowing downward drops from one plate to the next and intermingles thoroughly with the upward traveling air so as to not only cool but clean the air by washing out any ascending particles of dust, dirt, insecticides or the like derived from the produce. A de-mister 31 positioned above the manifold is employed to remove mechanically as much water content from the air as possible. The de-mister can be made in a number of ways but preferably includes a surface such as rubberized sterile animal hair to serve as an inert trap for water droplets which enlarge and fall downward from the de-mister as the air passes thereby. Thus there is discharged through the de-mister a stream of cooled, cleaned and relatively humid air without free water which flows through a fan 32 into the product compartment. It is now necessary to circulate this air through and around the produce containers to effect the cooling of the product.

Figure 3:
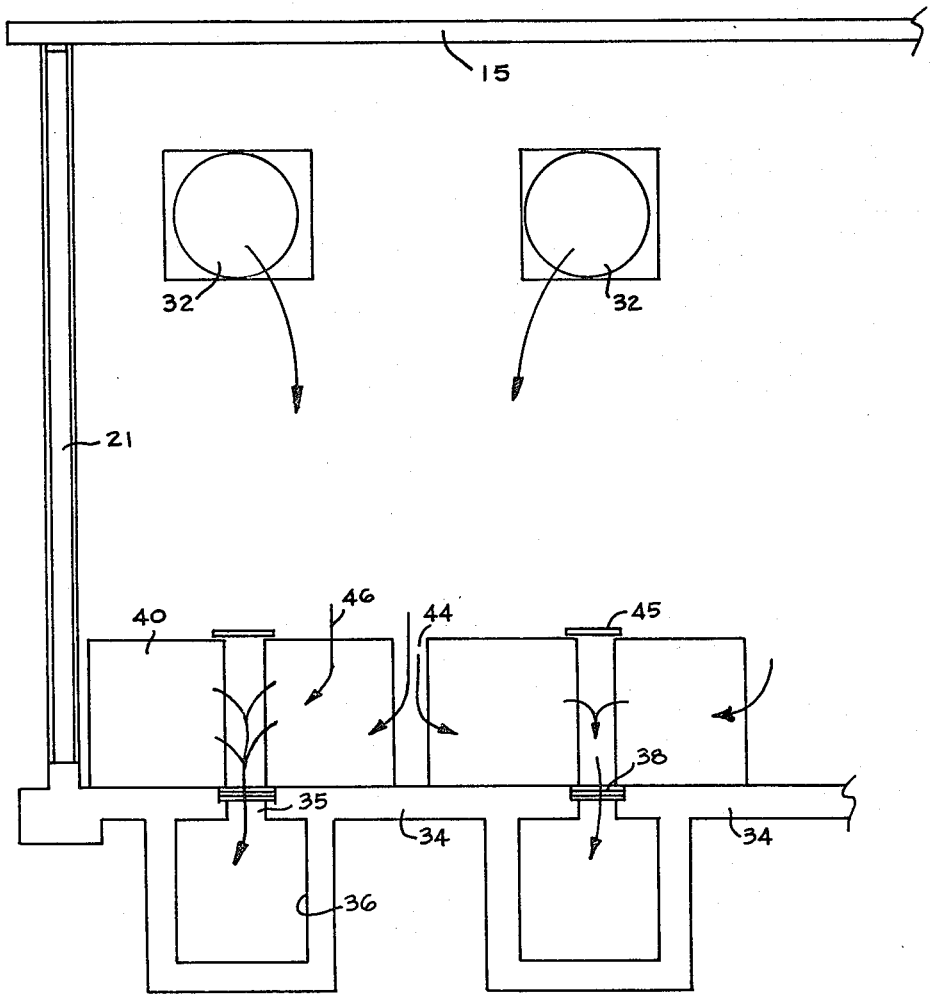
FIG. 3 is an enlarged cross-sectional view along the line 3—3 of FIG. 1.

For this purpose and in accordance with the present invention, the floor 14 of the enclosure is formed of a plurality of elongated parallel positioned sections 34 positioned in spaced relationship to form a plurality of slots 35 extending away from the cooling tower. As shown primarily in FIG. 3, each of these slots connect with and overlie a parallel running air duct 36 extending beneath the floor and connecting into a chamber 37 beneath the cooling tower. A grating 38 can be placed over each of the slots to prevent things from dropping into the air duct. Air in each duct 39 adjacent the chamber 37 is pulled from the produce enclosure down through the associated slot 35 and into the air duct to be expelled into the cooling tower for cooling, cleaning and subsequent expulsion back into the produce chamber by the fans 32.

The floor sections 34 are made sufficiently wide to accommodate at least two rows 40 and 41 of produce pallets, one positioned on each side of the air duct. Sufficient space 44 between the adjacent rows on a floor section allows for air to enter between the rows. By placing means to block the flow of air from the top of the pallet loads directly to the slots 35, such as the solid members or air blocks 45, air is forced to flow through the pallet loads in the direction indicated by the arrows 46. Because the air ducts 36 are too large, there is little flow resistance therethrough and the air is pulled uniformly through the slot along its entire length. This effect serves to cause cool air to pass through the pallet loads evenly along the entire length of the rows 40 and 41 for uniform cooling of the produce.

Periodically insufficient product is placed into the produce enclosure to make use of the total length of all the slots. When this condition is encountered, the air blocks which are normally placed between pallet loads and over the slots are merely dropped down to be placed directly on the floor over the slots to prevent air from passing therethrough where no pallet loads are placed to be cooled.

In the alternative and if sufficient air ports are located in the bottom of the pallets or bins, it is possible to place a row or stack directly over the floor slots for cooling the contained produce. Of course less produce is cooled per slot but with sufficient air flow the cooling is accomplished in less time.

I claim:

1. A produce cooler for cooling produce in containers comprising:

an enclosure having side walls, ceiling and floor, said floor comprising a plurality of elongated sections on which produce in containers can be placed, said floor sections being positioned in parallel relationship to form parallel extending slots therebetween;

an air duct beneath the floor adjacent each slot and in fluid flow relationship with said slot to receive air passing from the enclosure and through said slot;

air circulating means to pull the air through said air duct and expel it back into the enclosure;

means to cool said air prior to expulsion back into the enclosure;

said elongated floor sections being of sufficient width to allow the produce containers to be stacked along each side of said slots; and means to seal against air flow downward between containers positioned on opposite sides of each said floor slot to force the air flowing into said slots to pass through said containers and cool said produce.

2. A produce cooler as defined in claim 1 including means to seal against the passage of air through those slots having no produce stacked therealong.

3. A produce cooler as defined in claim 1 wherein said cooling compartment is positioned in the middle of said enclosure and said floor sections extend outward therefrom in at least two directions.

4. A produce cooler as defined in claim 1 wherein said air circulating means is a fan positioned in said air duct.

5. A produce cooler as defined in claim 1 wherein said means to cool said air includes a cooling compartment with means to inject cooled water into said air flow.

* * * * *